US009822749B2

(12) United States Patent
Derenthal et al.

(10) Patent No.: US 9,822,749 B2
(45) Date of Patent: Nov. 21, 2017

(54) FUEL INJECTOR

(71) Applicants: Marc-Jean Derenthal, Nanjing (CN); Johann Bayer, Strullendorf (DE); Ralph Ittlinger, Weissach (DE)

(72) Inventors: Marc-Jean Derenthal, Nanjing (CN); Johann Bayer, Strullendorf (DE); Ralph Ittlinger, Weissach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/365,989

(22) PCT Filed: Oct. 23, 2012

(86) PCT No.: PCT/EP2012/070915

§ 371 (c)(1),
(2) Date: Jun. 16, 2014

(87) PCT Pub. No.: WO2013/091936

PCT Pub. Date: Jun. 27, 2013

(65) Prior Publication Data

US 2015/0041567 A1 Feb. 12, 2015

(30) Foreign Application Priority Data

Dec. 20, 2011 (DE) ..... 10 2011 089 247

(51) Int. Cl.
*B05B 1/30* (2006.01)
*F02M 61/16* (2006.01)
*F02M 51/06* (2006.01)

(52) U.S. Cl.
CPC ..... *F02M 61/168* (2013.01); *F02M 51/061* (2013.01); *F02M 51/0682* (2013.01);
(Continued)

(58) Field of Classification Search
CPC ..... F02M 61/168; F02M 51/061; F02M 51/0682; F02M 2200/8061; F02M 2200/8084
(Continued)

(56) References Cited

U.S. PATENT DOCUMENTS 4,461,427 A * 7/1984 Kopse et al. ..... 239/533.5
4,938,193 A * 7/1990 Raufeisen et al. ..... 123/470
(Continued)

FOREIGN PATENT DOCUMENTS

CN 1116515 A 2/1996
CN 101248266 A 8/2008
(Continued)

OTHER PUBLICATIONS

International Search Report for PCT/EP2012/070915, dated Jan. 18, 2013.

*Primary Examiner* — Christopher Kim
*Assistant Examiner* — Adam J Rogers
(74) *Attorney, Agent, or Firm* — Norton Rose Fulbright US LLP; Gerard Messina

(57) ABSTRACT

A fuel injector for an internal combustion engine includes: an electromagnetic actuating element having a solenoid coil, a core and a valve casing as the outer solenoid circuit component, and a movable valve-closure body, which cooperates with a valve-seat surface assigned to a valve-seat body. The core and a connection pipe are fixedly connected in an inner opening of a thin-walled valve sleeve and the valve casing at the outer circumference of the valve sleeve is fixedly connected to the valve sleeve by being pressed in/on.

11 Claims, 6 Drawing Sheets

(52) U.S. Cl.
CPC ..... *F02M 2200/8061* (2013.01); *F02M 2200/8084* (2013.01)

(58) Field of Classification Search
USPC ..... 239/585.1
See application file for complete search history.

(56) References Cited

U.S. PATENT DOCUMENTS

| | | | | |
|---|---|---|---|---|
| 7,766,254 | B2 * | 8/2010 | Trapasso et al. | 239/135 |
| 7,886,718 | B2 * | 2/2011 | Manubolu et al. | 123/472 |
| 2003/0132318 | A1 * | 7/2003 | Frank | 239/533.9 |
| 2003/0164411 | A1 * | 9/2003 | Reiter | F02M 51/0671 239/533.12 |
| 2007/0095745 | A1 * | 5/2007 | Sebastian | 210/439 |
| 2009/0179090 | A1 * | 7/2009 | Reiter | F02M 51/0682 239/585.1 |
| 2010/0006068 | A1 * | 1/2010 | Maier | F02M 51/061 123/472 |

FOREIGN PATENT DOCUMENTS

| | | | |
|---|---|---|---|
| CN | 101981359 | A | 2/2011 |
| DE | 199 00 405 | | 7/2000 |
| DE | 101 03 933 | | 8/2002 |
| DE | 10 2005 025953 | | 12/2006 |
| DE | 10 2005 040363 | | 3/2007 |
| DE | 10 2005 061408 | | 6/2007 |
| DE | 20 2008 004065 | | 6/2008 |
| DE | 10 2007 008863 | | 8/2008 |
| EP | 1358402 | A1 | 11/2003 |
| JP | 2002534639 | A | 10/2002 |
| JP | 2004518066 | A | 6/2004 |
| JP | 2009520171 | A | 5/2009 |
| JP | 2010519451 | A | 6/2010 |
| WO | WO 2005/066487 | | 7/2005 |

* cited by examiner

FUEL INJECTOR

BACKGROUND OF THE INVENTION

1. Field of the Invention

The present invention relates to a fuel injector.

2. Description of the Related Art

A fuel injector, which includes an electromagnetic actuation body having a solenoid coil, an internal pole and an external magnetic circuit component as well as a movable valve-closure body, which cooperates with a valve seat assigned to a valve-seat body, is already known from published German patent application document DE 199 00 405 A1. The valve-seat body and the internal pole are placed in an inner opening of a thin-walled valve sleeve, and the solenoid coil and the external magnetic circuit component are positioned on the outer periphery of the valve sleeve. To affix the individual components in and on the valve sleeve, the magnetic circuit component in the form of a magnetic cup is first slipped over the valve sleeve, then the valve-seat body is pressed into the inner opening of the valve sleeve, so that a firm connection of valve sleeve and magnetic circuit component is achieved solely by the pressing-in of the valve-seat body. Once an axially movable valve needle has been installed inside the valve sleeve, the internal pole is affixed inside the valve sleeve by pressing it in. When the magnetic-circuit component is press-fitted onto the valve sleeve solely by pressing the valve-seat body in, there is a high risk that the press-fitted connection may loosen. Pressing the internal pole into the valve sleeve causes undesired cold welds in the press-fitting region.

BRIEF SUMMARY OF THE INVENTION

The fuel injector of the present invention has the advantage that it is able to be produced inexpensively and in a particularly simple manner. According to the present invention, the firm press fitting of at least two metallic components of the fuel injector is distinguished in that at least one of the component partners has two successive zones or subzones in its press-fitting region, which have a structure having grooves, the profile depth of the grooves, of individual zones or subzones, differing.

It is advantageous that it is possible to produce press-fitted connections between metallic component partners using cost-effective parts that are provided as deep-drawn or lathed components, such connections remaining tight and sealed in a safe and reliable manner over a long period of time while avoiding cold welds. The press-fitted connections can be produced in a very simple and cost-effective manner, since known and normally required separate work processes such as coating or oiling for improved joining of the component partners, or heating of the component partners for shrink-fitting may advantageously be dispensed with.

In one continuous material joining method, in an additional connection of the two components, besides the press-fitting, it is advantageously ensured that the full effectiveness of the seal and the stability of such a connection is produced. The different profile depth, according to the present invention, of the furrow-type or channel-type grooves in the various zones of the press-fit region allows welding to be possible in that is low in pores.

It is particularly advantageous to make up the press-fitting region of a component partner successively of an insertion bevel, a cylindrical press-fitting section and a welding region, the greatest profile depth of the grooves then being produced in the insertion bevel and the least profile depth of the grooves being produced in the welding range lying on the opposite side of the press-fit region. The press-fit section may have a zone of largely equal profile depth over its axial length, or a plurality of partial zones of different profile depth.

DETAILED DESCRIPTION OF THE INVENTION

For a better understanding of the measures according to the present invention, a fuel injector according to the related art together with its basic components is explained in the following text with the aid of FIG. 1.

Figure 1:
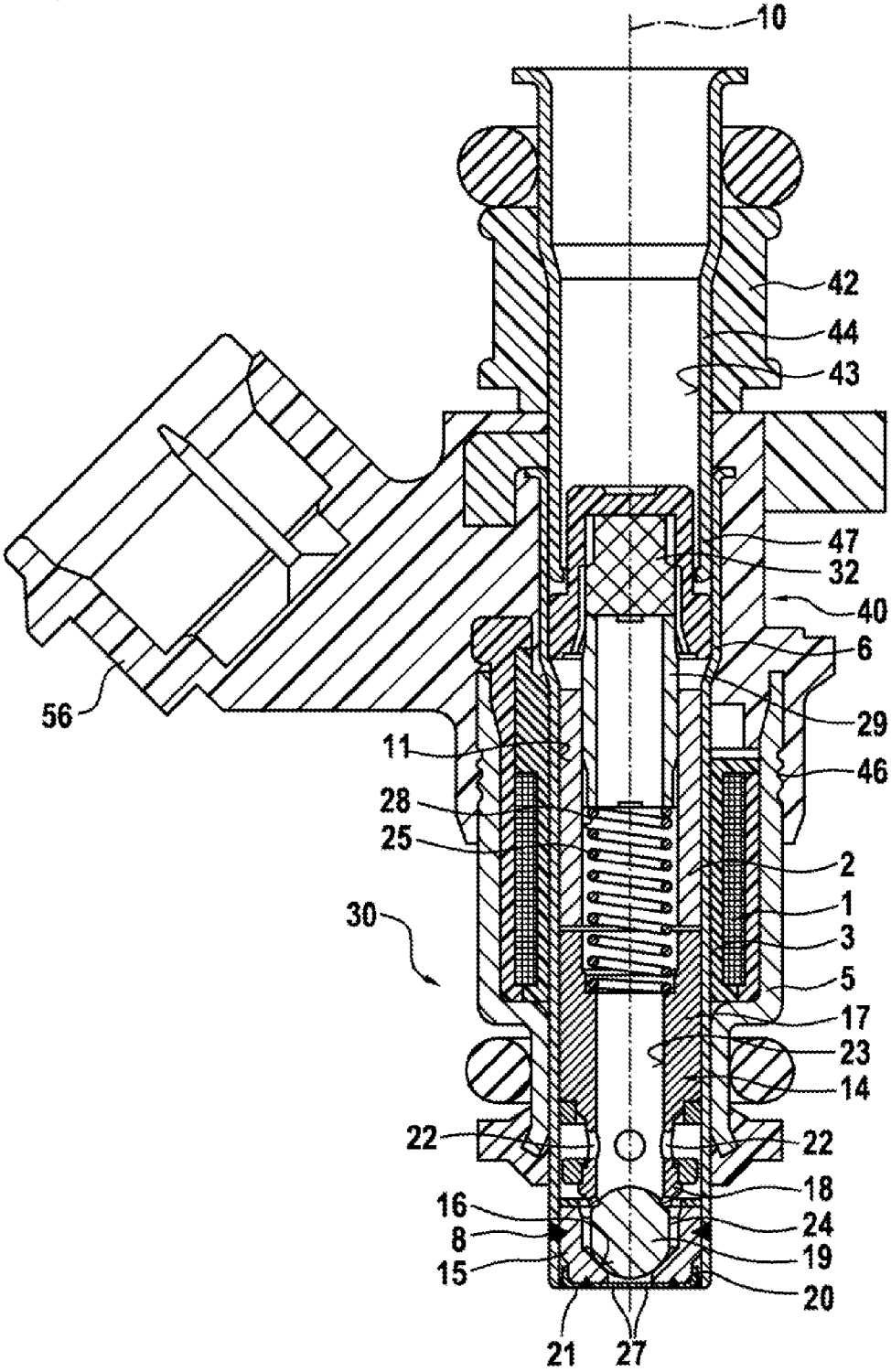
FIG. 1 shows a fuel injector according to the related art.

The electromagnetically operable valve shown by way of example in FIG. 1 in the form of an injection valve for fuel injection systems of mixture-compressing, spark-ignition internal combustion engines has a largely tubular core 2, which is surrounded by a solenoid coil 1 and is used as an internal pole and partially as a fuel throughput. In the circumferential direction, solenoid coil 1 is completely surrounded by an outer, sleeve-shaped and stepped, e.g., ferromagnetic valve jacket 5, which represents an outer magnetic circuit component in the form of a magnetic cup. Solenoid coil 1, core 2 and valve jacket 5 together form an electrically excitable actuating body.

While solenoid coil 1 embedded in a coil body 3 encloses a valve sleeve 6 on the outside, core 2 is inserted in an inner opening 11 of valve sleeve 6 extending concentrically with a longitudinal valve axis 10. Valve sleeve 6, that is made of ferrite, for example, is elongated longitudinally and has thin walls. Opening 11 is also used as a guide opening for a valve needle 14 that is axially movable along longitudinal valve axis 10. Valve sleeve 6 extends in the axial direction, e.g. over approximately half of the total axial extension, of the fuel injector.

In addition to core 2 and valve needle 14, a valve-seat body 15 is also disposed in opening 11, which is fastened on valve sleeve 6, e.g. by a welding seam 8. Valve-seat body 15 has a fixed valve-seat surface 16 as valve seat. Valve needle 14 is formed by, for instance, a tubular armature section 17, a likewise tubular needle section 18, and a spherical valve-closure body 19, valve-closure body 19 being permanently joined to needle section 18 by a welding seam, for example. Mounted on the downstream end face of valve-seat body 15 is an apertured spray disk 21 e.g. in the shape of a cup, whose bent and circumferentially running retention rim 20 is directed upward counter to the direction of flow.

The firm connection of valve-seat body 15 and apertured spray disk 21 is implemented e.g. by a sealing welding seam running all the way around. One or several transverse openings 22 is/are provided in needle section 18 of valve needle 14, so that fuel flowing through armature section 17 in an inner longitudinal bore 23 is able to exit and flow along valve-closure body 19, via flattened regions 24, for instance, to valve-seat surface 16.

The fuel injector is actuated electromagnetically in a known manner. For the axial movement of valve needle 14 and thus for opening the fuel injector counter to the spring force of a restoring spring 25 that engages with valve needle 14, or for closing the fuel injector, use is made of the electromagnetic circuit having solenoid coil 1, internal core 2, external valve coat 5, and armature section 17. Via the end facing away from valve-closure body 19, armature section 17 is oriented toward core 2.

Spherical valve-closure body 19 cooperates with valve-seat surface 16 of valve-seat body 15, which valve-seat surface 16 is frustoconically tapered in the direction of flow and is developed in the axial direction downstream from a guide opening in valve-seat body 15. Apertured spray disk 21 has at least one, for example, four spray-discharge orifices 27 formed by eroding, laser drilling or stamping.

The insertion depth of core 2 in the fuel injector is decisive for, among other things, the lift of valve needle 14. When solenoid coil 1 is not energized, the one end position of valve needle 14 is defined by the contact of valve-closure body 19 with valve seat surface 16 of valve-seat body 15, while when solenoid coil 1 is energized, the other end position of valve needle 14 results from the contact of armature section 17 with the downstream core end. The lift is set by an axial displacement of core 2, which is produced by a metal-cutting method such as turning, for example, and is subsequently fixedly joined to valve sleeve 6 according to the desired position.

In addition to restoring spring 25, an adjustment element in the form of an adjustment sleeve 29 is inserted into a flow bore 28 of core 2, which extends concentrically with respect to longitudinal valve axis 10 and serves as conduit for the fuel in the direction of valve-seat surface 16. Adjustment sleeve 29 adjusts the initial spring force of restoring spring 25 resting against adjustment sleeve 29, which spring is in turn resting against valve needle 14 by its opposite side, an adjustment of the dynamic spray-discharge quantity being implemented by adjustment sleeve 29, as well. A fuel filter 32 is disposed above adjustment sleeve 29 in valve sleeve 6.

The fuel injector described up to this point is characterized by its especially compact design, so that a very small, manageable fuel injector is created. These components form a preassembled, self-contained module, which is referred to below as functional component 30. Functional component 30 thus essentially includes electromagnetic circuit 1, 2, 5, and a sealing valve (valve-closure element 19, valve-seat body 15) followed by a jet-conditioning element (apertured spray disk 21), as well as valve sleeve 6 as base element.

Independently of functional component 30, a second module is produced, which is referred to as connecting part 40 in the following text. Connection part 40 is characterized mainly by the fact that it includes the electrical and the hydraulic connection of the fuel injector. Connection part 40, executed largely as a plastic part, therefore has a tubular base body 42 acting as a fuel inlet connection. A flow bore 43, extending concentrically with longitudinal valve axis 10, of an inner connection pipe 44 in base element 42 is used as fuel intake and has fuel flowing through it in the axial direction from the inflow-side end of the fuel injector.

A hydraulic connection of connecting part 40 and functional part 30 in the fully installed fuel injector is achieved in that flow bores 43 and 28 of both modules are placed with respect to each other in such a way that an unimpeded flow of the fuel is ensured. When connecting part 40 is mounted on functional component 30, a lower end 47 of connection pipe 44 projects into opening 11 of valve sleeve 6 in order to increase the stability of the connection. Base element 42 made of plastic can be sputtered onto functional part 30, so that the plastic directly surrounds parts of valve sleeve 6 and valve casing 5. Reliable sealing between functional part 30 and base element 42 of connecting part 40 is achieved via, for instance, a labyrinth seal 46 on the periphery of valve casing 5.

A likewise extruded electrical connection plug 56 is also part of this base 42. At their opposite end to connection plug 56, the contact elements are connected electrically to solenoid coil 1.

FIGS. 2 through 8 show metal components of the fuel injector, which are each fixedly connected to at least one other metal component, using press-fitting. In particular, the components valve sleeve 6 and connection pipe 44 are involved, it having to be explicitly emphasized that the measures shown and described according to the present invention are adequately transferable to all press-fit regions of two metallic components in the fuel injector.

To connect fixedly to one another metallic components in the fuel injector, press fits are suitable between the two components to be fastened. However, press fits as a rule cause plastic or elastic buckling or stretching of the components, depending on the position tolerance, the material and component geometry. If the component partners are unable to expand or buckle because of their rigidity, or if they are too soft in their material, as in the case of magnetically soft chromium steels, then cold welds ("seizures") will most likely occur during the joining process of the press-fitting action. Furthermore, the installation conditions of the component partners have to be taken into account. If the press-fitted connection is subjected to internal pressure, e.g., in the installed state, then this can lead to expansions and widening. This in turn entails the risk that the press-fitted connection will loosen and, in the worst case, that the connection will come apart. To prevent this, the highest possible pressure force should be generated, which, however, increases the tendency of the components to form cold welds. Of course, it is possible to narrow the tolerances and improve the press-fitted connections by labor-intensive precise and costly processing methods such as fine grinding or honing.

However, the goal consists of producing press-fitted connections between metallic component partners, if possible using cost-effective parts that are provided as lathed components, such connections remaining tight and sealed in a safe and reliable manner over a long period of time while avoiding cold seals. However, the press-fitted connections should be produced in a very simple and cost-effective manner, which is why a separate working step of coating, oiling or heating of the component partners for shrink-fitting purposes is dispensed with.

Figure 2:
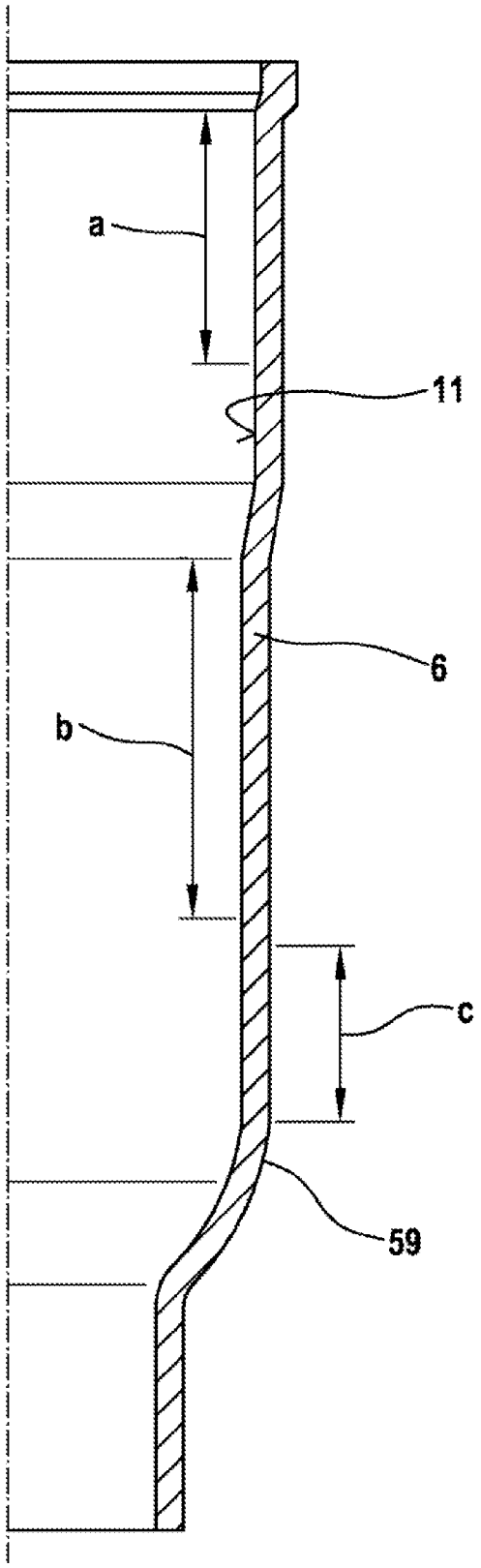
FIG. 2 shows a detailed view of a valve housing.

In FIG. 2 a thin-walled valve sleeve 6 is shown by way of example, which extends across a large portion of the axial length of the fuel injector and into which connection pipe 44 (FIG. 3) is able to be press-fitted in a region a, and core 2 is able to be press-fitted in a region b, and onto which valve casing 5 is able to be press-fitted in a region c.

Figure 3:
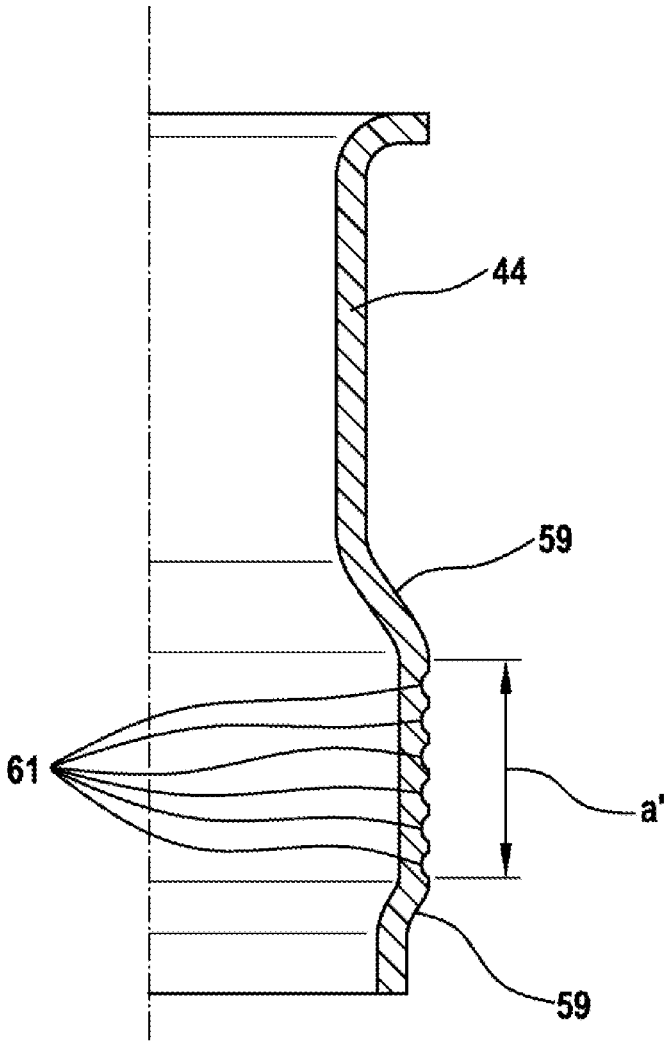
FIG. 3 shows a detailed view of a connecting pipe.

Correspondingly, connection pipe 44 according to FIG. 3 has an outer press-fitting region a', which corresponds to region a to form a press-fitted connection when installed in valve sleeve 6. Letters a and a' denote regions that are basically suitable for material contact in the press-fitted connection; however, it is by no means required that the press-fitted connection be implemented across the entire length of a and a', as will be explained with reference to FIGS. 4 through 8. Connection pipe 44 is to be installed in valve sleeve 6 with as little pressing-in force as possible. Inlet roundnesses 59, shown in FIG. 3, in the transition of press-fitting region a' to the axially following sections on both sides are present in a modified manner according to the present invention.

Figure 4:
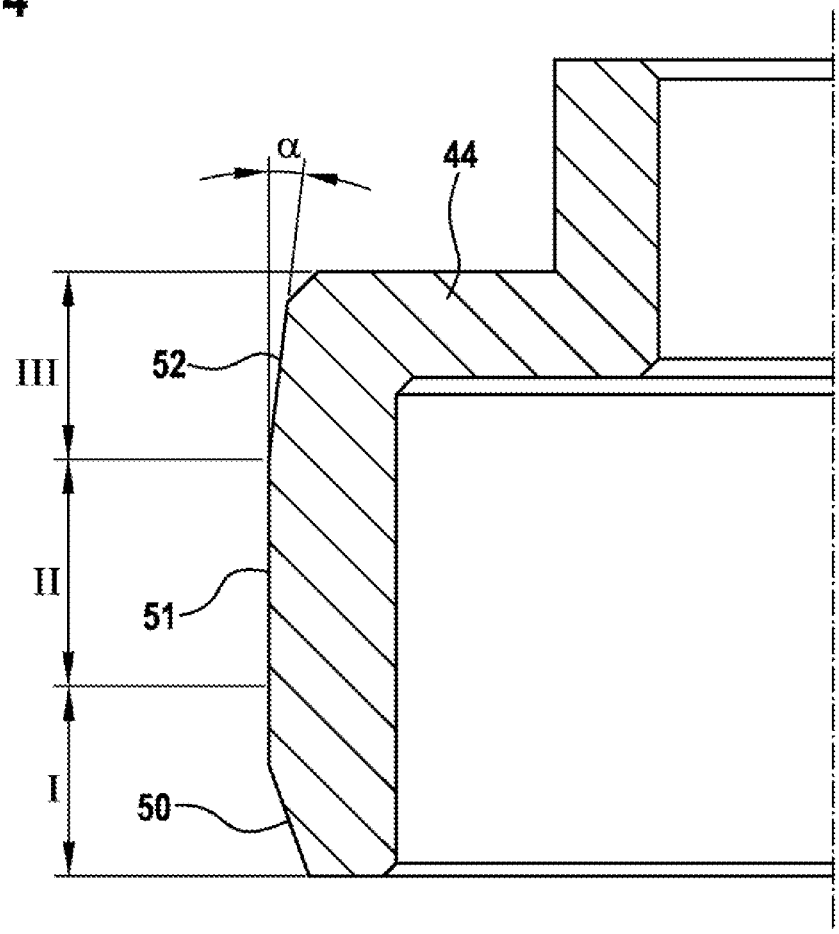
FIG. 4 shows a detailed view of a connection pipe before a profiling according to the present invention.

FIG. 4 shows a detailed view of a connection pipe 44 before a profiling according to the present invention. This makes it clear that press-fitting region a' subdivides into three zones at connection pipe 44. Zone I is characterized by an insertion bevel 50, which is developed either as a slantwise inclined or slightly archedly designed material reduction running all around in annular fashion. This insertion bevel 50 is used for the reliable, centered and chip-preventing insertion of component partners 6, 44 that are to be press-fitted into each other. Zone II is adjacent to zone I, and it forms the actual cylindrical press-fitting section 51. On the side opposite insertion bevel 50, cylindrical press-fitting section 51 is followed by a zone III which, similar to insertion bevel 50, runs in a set-back manner and defines a welding region 52. In the exemplary embodiment shown in FIG. 4, welding region 52 runs in a manner set back, inclined slantwise at an angle $\alpha$ with respect to the outer lateral surface of cylindrical press-fit section 51. The angle amounts to ca. 1° to 5° in this instance.

Figure 5:
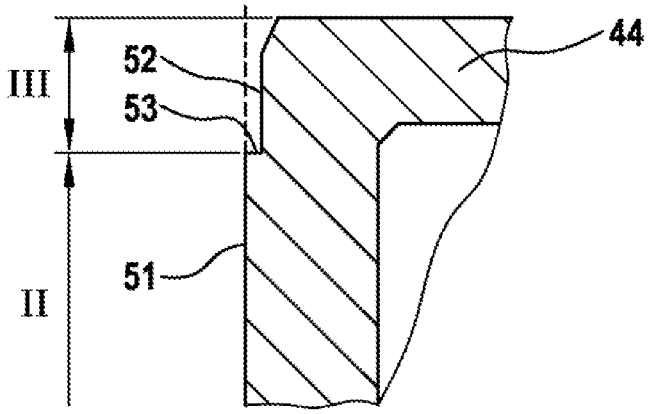
FIG. 5 shows a detailed view of an alternative connection pipe before a profiling according to the present invention.

FIG. 5 shows a detailed view of an alternative connection pipe 44 before a profiling according to the present invention. In this exemplary embodiment, zone III is set back abruptly with respect to zone II, acting as press-fitting section 51, over a shoulder 53, so that the outer lateral surface of welding region 52 runs at a smaller outside diameter, essentially parallel to the outer lateral surface of cylindrical press-fitting section 51.

Turned connecting pipes 44 lead to cold welding in the case of a large interference fit. In order to prevent this, it is known that one may connect, in an attached manner, furrow-type or channel-type grooves 61 in press-fit region a'. For the actual press-fitting of the components partners, connection pipe 44 in valve sleeve 6, in this case, the profiling of press-fit region a' is a very effective measure of avoiding the undesired effect described above. However, if the two components 6, 44 are additionally secured to each other using a continuous material joining method, such as welding or laser welding, and are sealed, the profiling in press-fit region a' may perhaps not bring about its full effectiveness. For reasons of strength, it may be necessary that the weld penetration depth in welding region 52 (see FIG. 8) amount to e.g. 0.8 to 1.2 mm. During the fusing of press-fit region a', an undesired formation of pores may take place in welding seam 54, that impairs the strength. This, in turn, results from a volume increase of the heated and chambered air in press-fit region a', that is passed through by grooves 61, and caused by the heat input from the welding.

Figure 6:
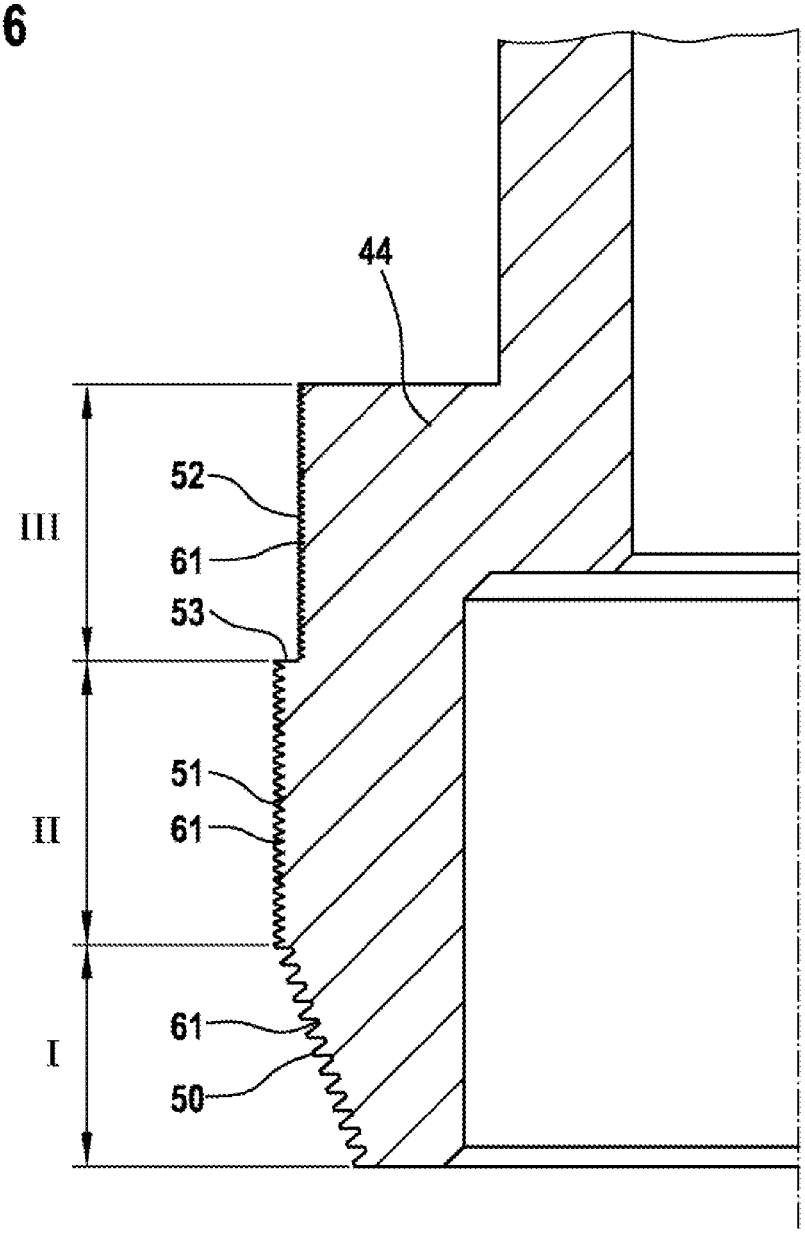
FIG. 6 shows a detailed view of a connection pipe having a first profiling according to the present invention.
Figure 7:
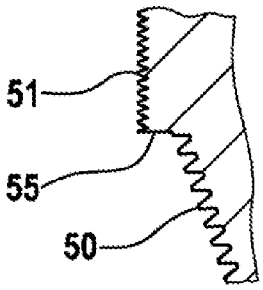
FIG. 7 shows a section of the view according to FIG. 6 having an interfering shoulder that is to be avoided.

Because of this, a variable profile depth of the furrow-type or channel-type grooves 61 in zones I, II, III of press-fit region a' is provided, which enables welding resulting in fewer pores. FIG. 6 shows a detailed view of a connection pipe 44 having a first profiling according to the present invention. In welding region 52 (zone III) set back, in this case, by a shoulder 53, the smallest profile depth is present. The profile depth of grooves 61 in press-fit region 51 (zone II) may correspond to that of zone II or be slightly larger. In any case, zone I, having insertion bevel 50, has the region of grooves 61 that have the largest profile depth. It is important that the transition from a coarse profiling to a finer profiling be executed, as in this case, tangentially from zone I to zone II, so that a well-balanced profile depth transition comes about. On this point, FIG. 7 shows a section of a view according to FIG. 6, having an interfering shoulder 55, that is absolutely to be avoided, or another type of abrupt raising.

It should be noted that the furrow-type or channel-type grooves 61, according to the present invention, are not shown to scale with their profile depth, but are rather clearly drawn in exaggerated fashion for a better understanding of the present invention.

Figure 8:
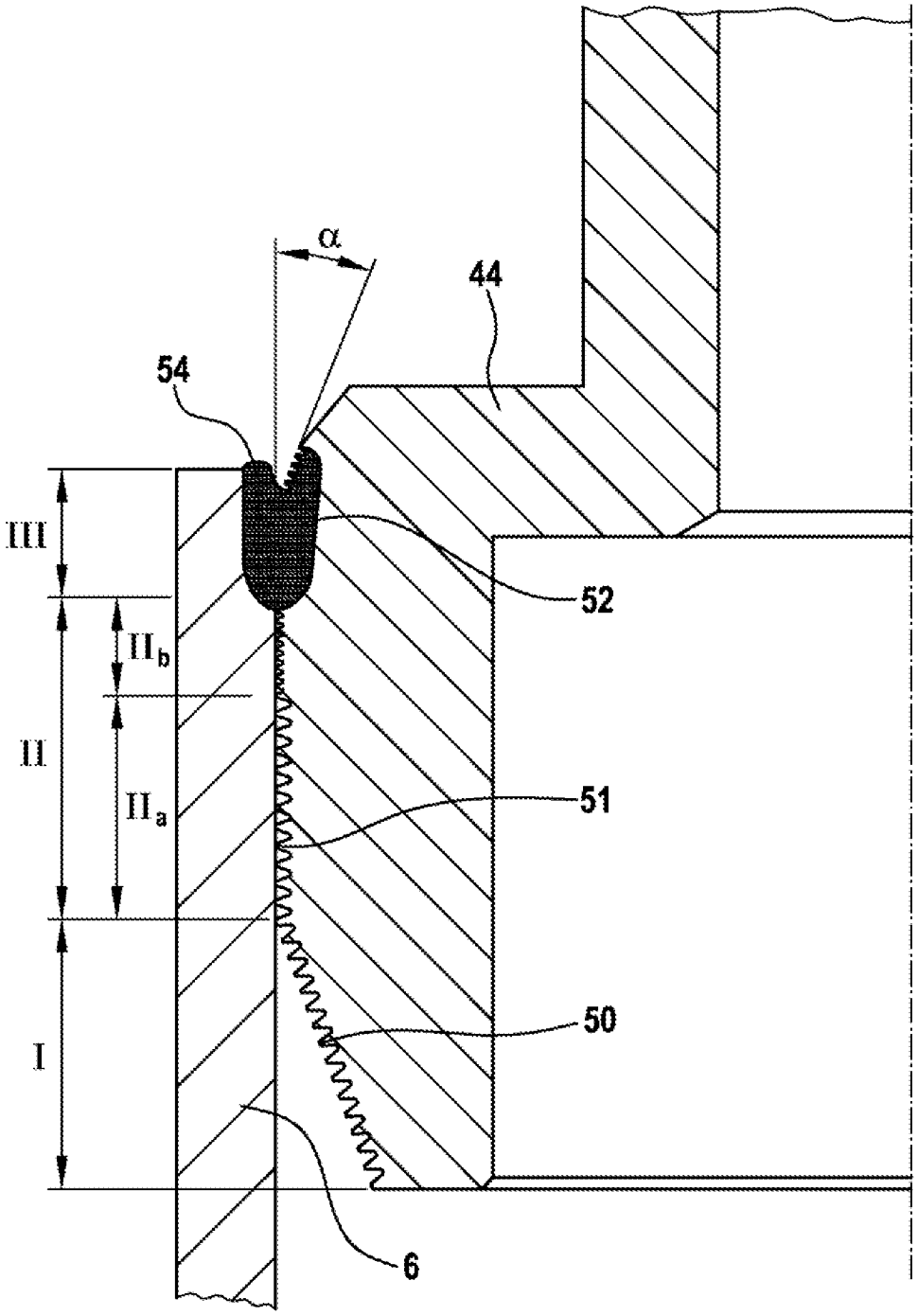
FIG. 8 shows a detailed view of a connection pipe having a second profiling according to the present invention in an installed situation in a valve sleeve.

FIG. 8 shows a detailed view of a connection pipe 44 having a second profiling according to the present invention, in an installation situation in a valve sleeve 6. In contrast to the execution shown in FIG. 6, in this case, middle cylindrical press-fit section 51 is subdivided into two partial zones IIa and IIb. Whereas, starting from zone I, grooves 61 of first partial zone IIa still has the same sized profile depth as grooves 61 of insertion bevel 50, grooves 61 of partial zone IIb of press-fitting section 51 have grooves 61 of lesser depth, whose low profile depth then continues into welding region 52.

What is claimed is:

1. A fuel injector for a fuel injection system of an internal combustion engine, the fuel injector having a longitudinal valve axis, comprising: a valve-closure body; a valve-seat surface provided on a valve-seat body, wherein the valve-closure body cooperates with the valve-seat surface; an excitable actuator for operating the valve-closure body; at least one spray-discharge orifice; and at least two metallic components which are fixedly connected to one another by press-fitting, wherein for the press-fitting of the at least two metallic components, both of the metallic components have completely metallic press-fitting regions, wherein at least one of the press-fitting regions has at least two successive zones disposed on a same side of one of the metallic components, wherein: the successive zones are successive with respect to one another along a direction that is parallel to the longitudinal valve axis, each zone has a structure including grooves, a profile depth of the grooves of a first zone differs from a profile depth of the grooves of a second zone, and the grooves of the first zone and the grooves of the second zone are disposed on the same side of the one of the metallic components.

2. The fuel injector as recited in claim 1, wherein the grooves extend all the way around the press-fitting region.

3. The fuel injector as recited in claim 1, wherein the at least one of press-fitting regions includes the following successively contiguous portions: an insertion bevel; a cylindrical press-fitting section; and a welding region.

4. The fuel injector as recited in claim 3, wherein one of: (i) the welding region extends inclined at an angle relative to the press-fitting section; or (ii) the welding region is set back via a shoulder with respect to the press-fitting section.

5. The fuel injector as recited in claim 3, wherein the grooves in the welding region have the smallest profile depth among the grooves of the press-fitting region.

6. The fuel injector as recited in claim 5, wherein the profile depth of the grooves in the press-fitting section is greater than the profile depth of the grooves in the welding region.

7. The fuel injector as recited in claim 6, wherein the press-fitting section is subdivided into two subzones, the profile depth of the grooves in the first subzone in the direction towards the insertion bevel being greater than the profile depth of the grooves in the second subzone in the direction towards the welding region.

8. The fuel injector as recited in claim 6, wherein the grooves in the insertion bevel have the largest profile depth among the grooves of the press-fitting region.

9. The fuel injector as recited in claim 8, wherein the at least two metallic components are fixedly connected to each other in the welding region by a continuous material.

10. The fuel injector as recited in claim 8, wherein a transition from a coarse profiling to a finer profiling of the profile depth of the grooves in the press-fitting region is carried out tangentially.

11. The fuel injector as recited in claim 8, wherein:

the at least two metallic components include a thin-walled valve sleeve and at least one of a valve casing, a connection pipe and a core; and at least one of (i) the valve casing is pressed into place on the thin-walled valve sleeve, and (ii) at least one of the connection pipe and the core is pressed in place into the thin-walled valve sleeve.

* * * * *